US009861171B1

(12) United States Patent
Burnside

(10) Patent No.: US 9,861,171 B1
(45) Date of Patent: Jan. 9, 2018

(54) WATER BOTTLE AND CELL PHONE HOLDER

(71) Applicant: Lorita Burnside, Miami, FL (US)

(72) Inventor: Lorita Burnside, Miami, FL (US)

( * ) Notice: Subject to any disclaimer, the term of this patent is extended or adjusted under 35 U.S.C. 154(b) by 0 days.

(21) Appl. No.: 15/489,818

(22) Filed: Apr. 18, 2017

(51) Int. Cl.

| | |
|---|---|
| ***A45C 3/02*** | (2006.01) |
| ***A45C 11/00*** | (2006.01) |
| ***A45C 13/10*** | (2006.01) |
| ***A45F 3/02*** | (2006.01) |
| ***A45F 3/12*** | (2006.01) |

(52) U.S. Cl.
CPC ..... *A45C 11/00* (2013.01); *A45C 13/103* (2013.01); *A45F 3/02* (2013.01); *A45F 3/12* (2013.01); *A45C 2011/002* (2013.01); *A45C 2200/05* (2013.01); *A45C 2200/20* (2013.01)

(58) Field of Classification Search
CPC ..... A45C 2200/20
USPC ..... 150/106, 110; 224/148.4, 148.4 T
See application file for complete search history.

(56) References Cited

U.S. PATENT DOCUMENTS

| | | | | |
|---|---|---|---|---|
| D335,957 | S | 6/1993 | Cantrell | |
| 6,401,993 | B1 * | 6/2002 | Andrino | A45F 5/00 224/148.5 |
| 6,994,131 | B2 | 2/2006 | Dedmon | |
| 7,252,213 | B1 * | 8/2007 | DeSanto | A45F 5/00 224/148.4 |
| 7,293,635 | B2 | 11/2007 | Repke | |
| D625,158 | S * | 10/2010 | Sweeden | D7/709 |
| 7,912,522 | B2 | 3/2011 | Pierson | |
| 7,949,373 | B2 * | 5/2011 | Whiting | G06K 19/06187 455/557 |
| 8,646,970 | B2 * | 2/2014 | Mogil | A45C 5/02 224/612 |
| 8,820,367 | B2 * | 9/2014 | Reyes | A45F 3/02 150/106 |
| 8,919,623 | B1 * | 12/2014 | Bergeron | A45F 5/02 224/148.4 |
| 8,989,826 | B1 * | 3/2015 | Connolly | A45C 1/06 361/679.01 |
| 9,398,793 | B2 * | 7/2016 | Marin | A45C 13/02 |
| 2009/0194571 | A1 | 8/2009 | Evans | |
| 2011/0303708 | A1 | 12/2011 | Dudley | |
| 2013/0072266 | A1 | 3/2013 | Shattuck | |
| 2013/0098954 | A1 * | 4/2013 | Inglis | A45F 5/00 224/148.4 |
| 2014/0061406 | A1 * | 3/2014 | Chevalier | F16M 11/08 248/205.1 |
| 2014/0076750 | A1 | 3/2014 | Monaco | |
| 2015/0065206 | A1 * | 3/2015 | Rojas | G06F 1/16 455/575.1 |

* cited by examiner

*Primary Examiner* — Sue A Weaver

(57) ABSTRACT

The water bottle and cell phone holder is a carried item of luggage. The water bottle and cell phone holder is a receptacle that stores a water bottle and a personal data device. The water bottle and cell phone holder is provisioned with a strap that allows the water bottle and cell phone holder to be carried by hand or hung from a shoulder. The water bottle and cell phone holder comprises a tube, a pocket, and a shoulder strap. The tube, pocket, and shoulder strap are attached in such a manner that a loop is formed. The loop allows the water bottle and cell phone holder to be either hand carried or hung from the shoulder. The tube stores the water bottle. The pocket stores the personal data device.

15 Claims, 4 Drawing Sheets

WATER BOTTLE AND CELL PHONE HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic items including purses, luggage, and hand carried bags, more specifically, a device able to hold a water bottle and a personal data device.

SUMMARY OF INVENTION

The water bottle and cell phone holder is a carried item of luggage. The water bottle and cell phone holder is configured for use with a water bottle. The water bottle and cell phone holder is further configured for use with a personal data device. The water bottle and cell phone holder is a receptacle that stores the water bottle and the personal data device. The water bottle and cell phone holder is provisioned with a strap that allows the water bottle and cell phone holder to be carried by hand or hung from a shoulder. The water bottle and cell phone holder comprises a tube, a pocket, and a shoulder strap. The tube, pocket, and shoulder strap are attached in such a manner that a loop is formed. The loop allows the water bottle and cell phone holder to be either hand carried or hung from the shoulder. The tube stores the water bottle. The pocket stores the personal data device.

These together with additional objects, features and advantages of the water bottle and cell phone holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the water bottle and cell phone holder in detail, it is to be understood that the water bottle and cell phone holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the water bottle and cell phone holder.

It is therefore important that the claims be regarded as including such equivalent construction insofar as they do not depart from the spirit and scope of the water bottle and cell phone holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
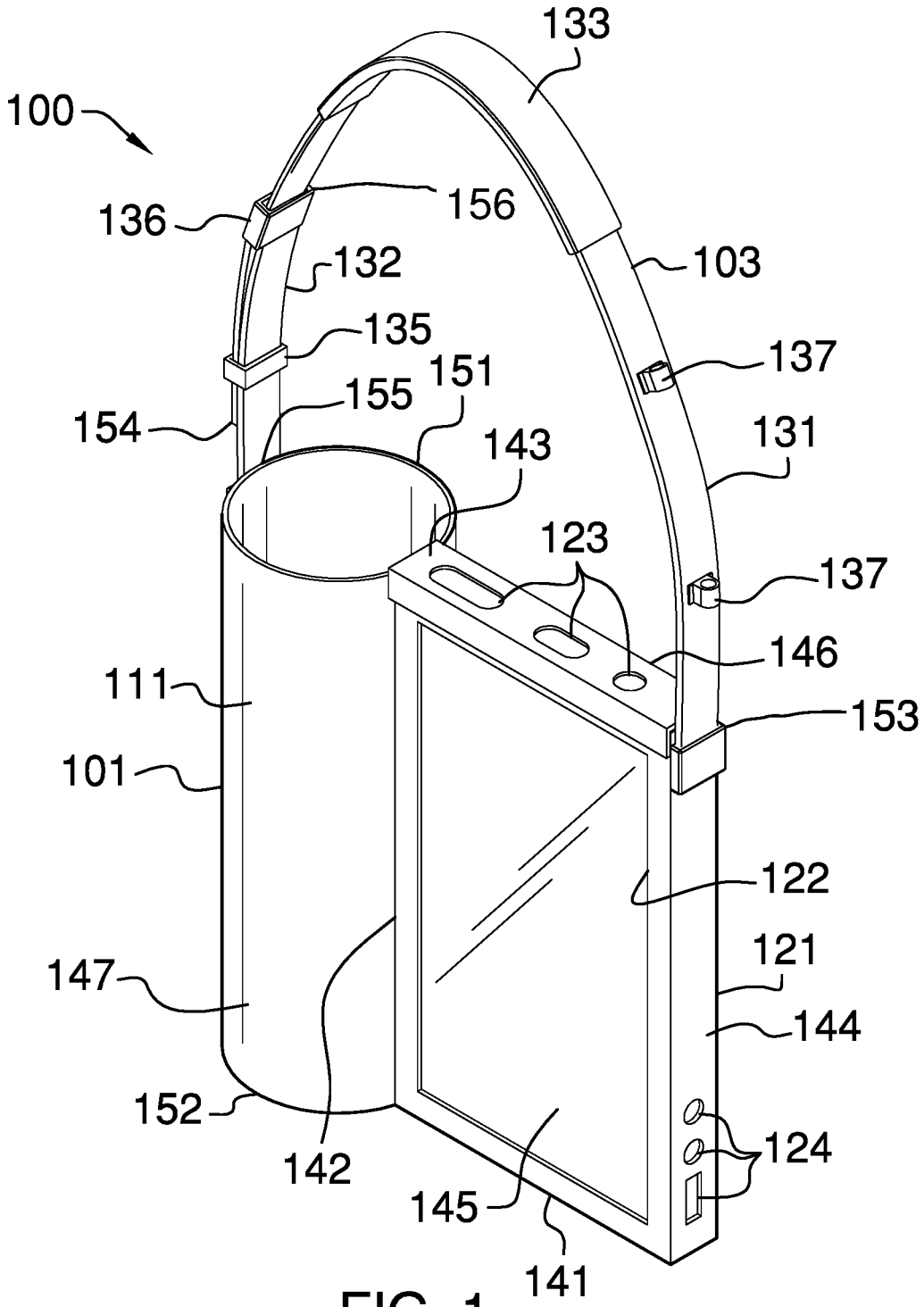
FIG. 1 is a perspective view of an embodiment of the disclosure.
Figure 2:
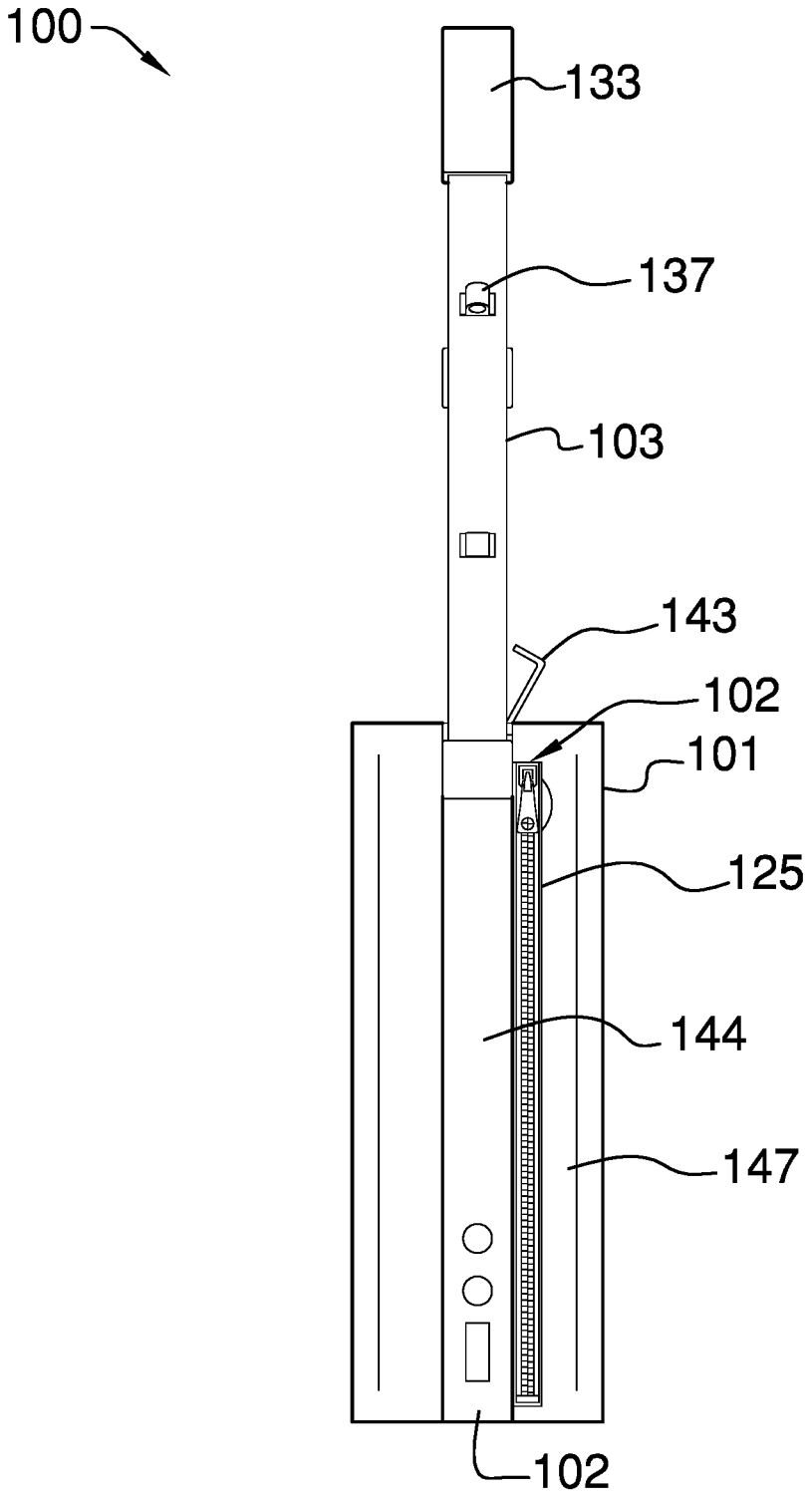
FIG. 2 is a side view of an embodiment of the disclosure.
Figure 3:
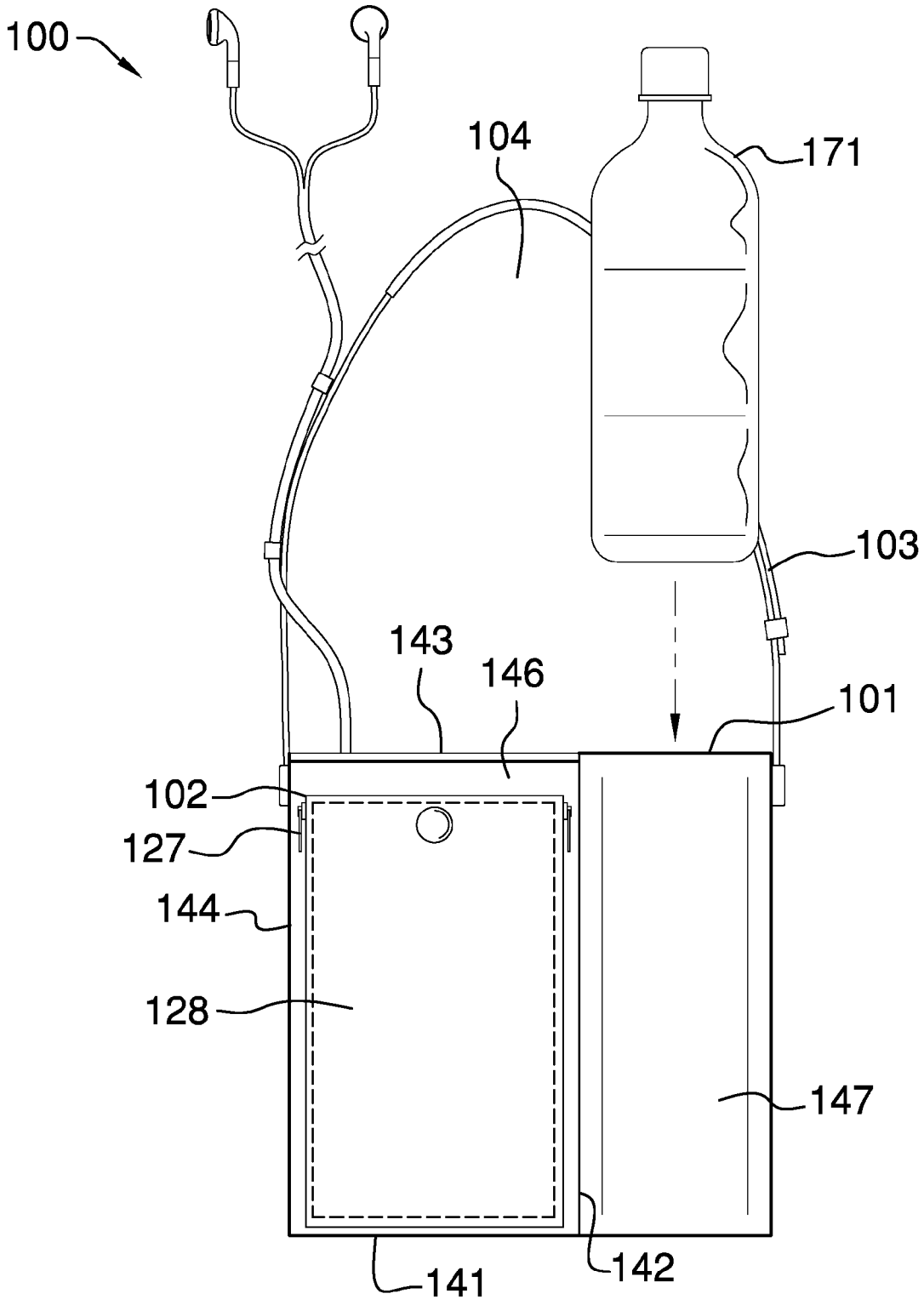
FIG. 3 is a rear view of an embodiment of the disclosure.
Figure 4:
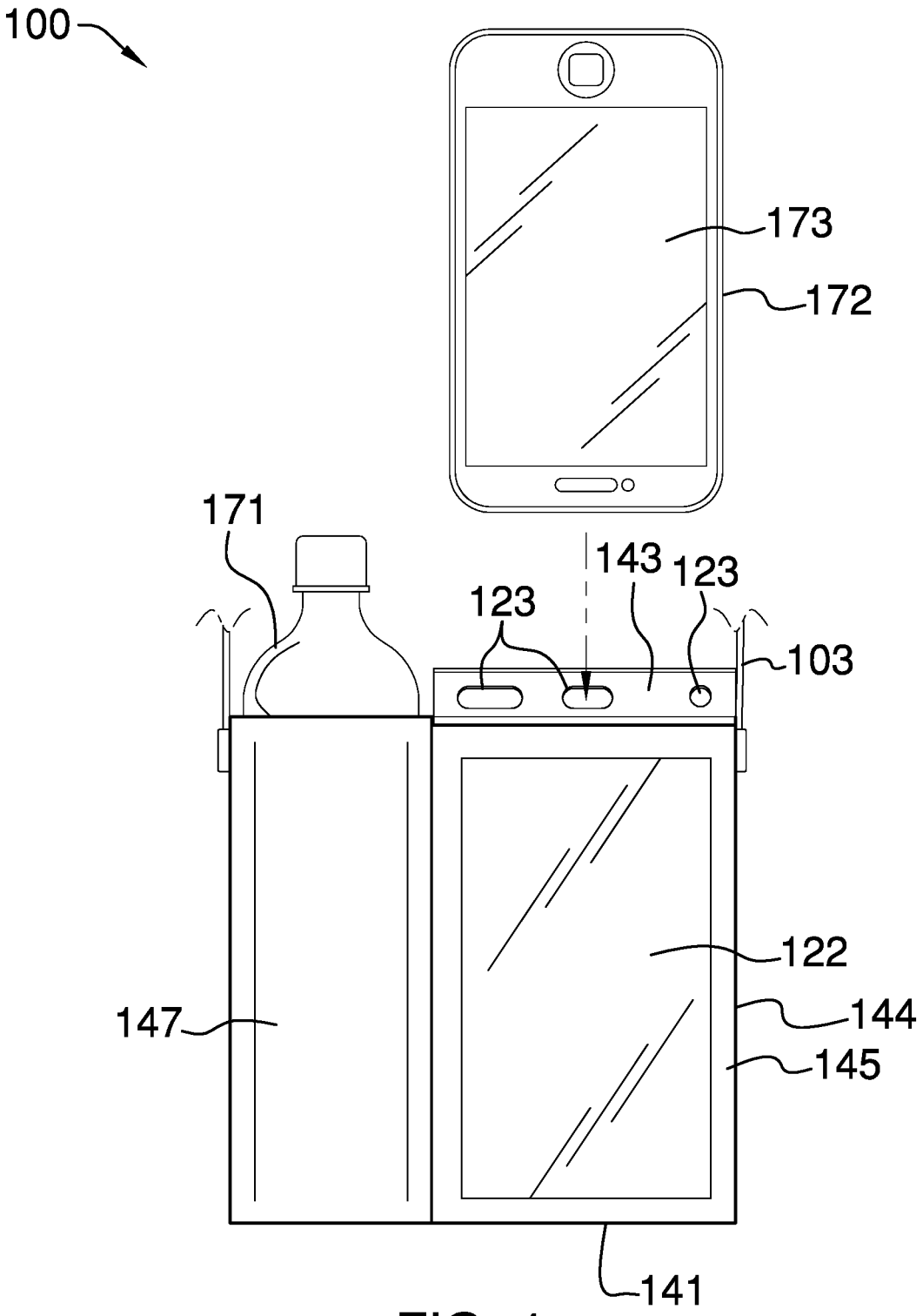
FIG. 4 is a front view of an embodiment of the disclosure.

Detailed reference will now be made to one or more potential embodiments of the disclosure, which are illustrated in FIGS. 1 through 4.

The water bottle and cell phone holder 100 (hereinafter invention) is a carried item of luggage. The invention 100 is configured for use with a water bottle 171. The water bottle 171 is a readily and commercially available containment device that is configured for use in storing fluids. The invention 100 is further configured for use with a personal data device 172. The personal data device 172 is a readily and commercially available electronic device. The invention 100 is a receptacle that stores the water bottle 171 and the personal data device 172. The invention 100 is provisioned with a shoulder strap 103 that allows the invention 100 to be carried by hand or hung from a shoulder. The invention 100 comprises a tube 101, a master pocket 102, and a shoulder strap 103. The tube 101, master pocket 102, and shoulder strap 103 are attached in such a manner that a loop 104 is formed. The loop 104 allows the invention 100 to be either hand carried or hung from the shoulder. The tube 101 stores the water bottle 171. The master pocket 102 stores the personal data device 172.

The tube 101 is a hollow cylindrical structure that is used to contain the water bottle 171. The tube 101 comprises a pipe 111. The pipe 111 is a readily and commercially available capped tube. The inner diameter of the pipe 111 is greater than the outer diameter of the water bottle 171 such that the water bottle 171 can be inserted into the pipe 111. The pipe 111 is further defined with a seventh face 147, a first end 151, and a second end 152. The seventh face 147 is the face of the cylinder that forms the pipe 111. The first end 151 of the pipe 111 is the open end. The second end 152 of the pipe 111 is the capped end.

The master pocket 102 is a hollow rectangular block structure that is used to contain the personal data device 172. The master pocket 102 comprises a block 121, a face aperture 122, a first plurality of access ports 123, a second plurality of access ports 124, and a zippered pocket 125.

The block 121 is a hollow rectangular block structure: 1) within which the personal data device 172 can be stored; and, 2) upon which the zippered pocket 125 is mounted. The block 121 is further defined with a first face 141, a second face 142, a third face 143, a fourth face 144, a fifth face 145, and a sixth face 146.

The first face 141 is the face of the block 121 that is distal from the shoulder strap 103. The second face 142 is the face of the block 121 that is proximal to the tube 101. The third face 143 is the face of the block 121 that is distal from the first face 141 of the block 121. As shown most clearly in FIGS. 2 and 4, the third face 143 is hinged such that the third face 143 can be rotated away from the interior space of the block 121 such that the personal data device 172 may be inserted into the master pocket 102. The fourth face 144 is the face of the block 121 that is distal from the second face 142 of the block 121. The fifth face 145 is the face of the block 121 that has the face aperture 122 formed in it. The sixth face 146 is the face of the block 121 that is distal from the fifth face 145 of the block 121.

The face aperture 122 is an aperture that is formed through the fifth face 145 of the block 121. The face aperture 122 is sized and positioned such that the display 173 of the personal data device 172 may be directly accessed without removing the personal data device 172 from the master pocket 102. The face aperture 122 is a rectangular opening. The display 173 is a visual interface that is associated with the personal data device 172.

Each of the first plurality of access ports 123 is an aperture that is formed through the third face 143 of the block 121. Each of the first plurality of access ports 123 is sized and positioned such that a switch mounted on the exterior surface of the personal data device 172 may be directly accessed without removing the personal data device 172 from the master pocket 102.

Each of the second plurality of access ports 124 is an aperture that is formed through the fourth face 144 of the block 121. Each of the second plurality of access ports 124 is sized and positioned such that a switch mounted on the exterior surface of the personal data device 172 may be directly accessed without removing the personal data device 172 from the master pocket 102.

The zippered pocket 125 is a storage pouch that is mounted on the sixth face 146 of the block 121. The zippered pocket 125 is the master pocket 102. The zippered pocket 125 comprises a zipper 127 and a first sheeting 128. In the first potential embodiment of the disclosure, the zipper 127 is a readily and commercially available fastener that is used to open and close the zippered pocket 125. Methods for the selection and use of zippers 127 are well known and documented in the textile arts. The first sheeting 128 is a commercially available composite textile that is attached to the sixth face 146 of the block 121 to form the pouch structure of the zippered pocket 125. The first sheeting 128 comprises one or more layers of conductive material that are used to form a Faraday cage around the zippered pocket 125. The Faraday cage prevents an RFID interrogator from interrogating any RFID tags that may be stored within the zippered pocket 125.

The shoulder strap 103 is a flexible strap structure that is connected to both the tube 101 and the master pocket 102. The shoulder strap 103 forms the loop 104. The loop 104 forms an enclosed negative space through which an arm can be inserted such that the invention 100 can be hung by placing the shoulder strap 103 directly on the shoulder.

The shoulder strap 103 comprises a first strap 131, a second strap 132, a shoulder pad 133, a first ring 135, a second ring 136, and a plurality of clip loops 137. The first strap 131 is a commercially available webbing. The second strap 132 is a commercially available webbing.

The first strap 131 is further defined with a third end 153 and a fourth end 154. The second strap 132 is further defined with a fifth end 155 and a sixth end 156. The third end 153 of the first strap 131 attaches to the fourth face 144 of the block 121. The fourth end 154 of the first strap 131 is a free end. The fifth end 155 of the second strap 132 attaches to the seventh face 147 of the pipe 111. The sixth end 156 of the second strap 132 is a free end.

The shoulder pad 133 is a cushion that is formed in a loop such that the first strap 131 can be inserted through the shoulder pad 133. The cushion is a padded structure that is included for reasons of comfort. The use of a shoulder pad 133 is well known and documented in the textile arts.

The first ring 135 is a commercially available ring shaped linking structure. As shown most clearly in FIG. 1, the fourth end 154 of the first strap 131 and the sixth end 156 of the second strap 132 are inserted through the first ring 135. The second ring 136 is a commercially available ring shaped linking structure. As shown most clearly in FIG. 1, the fourth end 154 of the first strap 131 and the sixth end 156 of the second strap 132 are inserted through the second ring 136. The first strap 131 and the second strap 132 are both inserted through the first ring 135. The first strap 131 and the second strap 132 are both inserted through the second ring 136. The purpose of the first ring 135 and the second ring 136 is to hold the fourth end 154 of the first strap 131 in a position that is proximal to the sixth end 156 of the second strap 132.

Each of the plurality of clip loops 137 is a ring like structure. Each of the plurality of clip loops 137 attaches to the first strap 131 such that domestic articles can be attached to any clip loop selected from the plurality of clip loops 137.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyano-acrylates, silicone, or latex based adhesives.

Capped Tube: As used in this disclosure, a capped tube is a tube with one closed end and one open end.

Clip: As used in this disclosure, a clip is a fastener that attaches to an object by gripping or clasping the object.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Diameter: As used in this disclosure, a diameter of an object is a straight line segment that passes through the center of an object. The line segment of the diameter is terminated at the perimeter or boundary of the object through which the line segment of the diameter runs.

Display: As used in this disclosure, a display is a surface upon which is projected an image, potentially including, but not limited to, graphic images and text, that is interpretable by an individual viewing the projected image in a meaningful manner.

Domestic Article: As used in this disclosure, a domestic article is an item or object: 1) that is commonly found within a household; or, 2) that is commonly carried by a person. Examples of domestic articles include, but are not limited to, keys and key fobs, personal data devices, glasses, remote controls, or personal storage items such as purses, briefcases, wallets, or cases.

Exterior: As used in this disclosure, the exterior is use as a relational term that implies that an object is not contained within the boundary of a structure or a space.

Fastener: As used in this disclosure, a fastener is a device that is used to join or affix two objects. Fasteners generally comprise a first element, which is attached to the first object and a second element which is attached to the second object such that the first element and the second element join to affix the first object and the second object. Common fasteners include, but are not limited to, zippers, snaps, buttons, buckles, quick release buckles, or hook and loop fasteners.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Inner Diameter: As used in this disclosure, the term inner diameter is used in the same way that a plumber would refer to the inner diameter of a pipe.

Interface: As used in this disclosure, an interface is a physical or virtual boundary that separates two different systems across which information is exchanged.

Interior: As used in this disclosure, the interior is use as a relational term that implies that an object is contained within the boundary of a structure or a space.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Negative Space: As used in this disclosure, negative space is a method of defining an object through the use of open or empty space as the definition of the object itself, or, through the use of open or empty space to describe the boundaries of an object.

Outer Diameter: As used in this disclosure, the term outer diameter is used in the same way that a plumber would refer to the outer diameter of a pipe.

Personal Data Device: As used in this disclosure, a personal data device is a handheld device that is used for managing personal information and communication. Examples of personal data device include, but are not limited to, cellular phones, tablets and smart phones.

Pipe: As used in this disclosure, the term pipe is used to describe a rigid hollow cylinder. While pipes that are suitable for use in this disclosure are often used to transport or conveys fluids or gases, the purpose of the pipes in this disclosure are structural. In this disclosure, the terms inner diameter of a pipe and outer diameter are used as they would be used by those skilled in the plumbing arts.

Pocket: As used in this disclosure, a pocket is a small pouch or storage space that is formed into an object. Pockets are often formed by joining a second textile or a second sheeting to a first textile or a first sheeting, respectively, by sewing or heat sealing respectively.

RFID: As used in this disclosure, RFID refers to Radio Frequency Identification technology. RFID is a wireless technology that uses electromagnetic field to identify and retrieve data from tracking tags that are placed on an object.

RFID Interrogator: As used in this disclosure, an RFID interrogator is a device that transmits a radio signal at frequency designed to activate RFID tracking tags that are tuned to operate at that frequency.

RFID Tracking Tag: As used in this disclosure, an RFID tracking tag is a reflective antenna that receives a radio signal from an RFID Interrogator and uses the energy received from the RFID interrogator signal to reflect a modified signal back to the RFID interrogator. The modified signal generally contains identification information about the RFID tag. The RFID interrogator receives and records these reflected signals. RFID tags are generally tuned to respond to a specific frequency. In this disclosure, though the RFID tags are mounted next to active components, the RFID tags themselves are passive, or unpowered, tags.

Ring: As used in this disclosure, a ring is term that is used to describe a flat or plate like structure through which an aperture is formed.

Sheeting: As used in this disclosure, sheeting is a material, such as a textile, a plastic, or a metal foil, in the form of a thin flexible layer or layers.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Textile: As used in this disclosure, a textile is a material that is woven, knitted, braided or felted. Synonyms in common usage for this definition include fabric and cloth.

Tube: As used in this disclosure, a tube is a hollow cylindrical device that is used for transporting liquids and gases. The line that connects the center of the first base of the cylinder to the center of the second base of the cylinder is referred to as the center axis of the tube or the centerline of the tube. In this disclosure, the terms inner dimension of a tube and outer dimension of a tube are used as they would be used by those skilled in the plumbing arts.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An item of luggage comprising:

a tube, a master pocket, and a shoulder strap;

wherein the tube, master pocket, and shoulder strap are attached in such a manner that a loop is formed;

wherein the item of luggage is a carried item of luggage;

wherein the item of luggage is configured for use with a water bottle;

wherein the item of luggage is further configured for use with a personal data device;

wherein the item of luggage is a receptacle that stores the water bottle and the personal data device;

wherein shoulder strap allows the item of luggage to be carried by hand or hung from a shoulder;

wherein the tube stores the water bottle;

wherein the master pocket stores the personal data device;

wherein the master pocket comprises a block, a face aperture, a first plurality of access ports, a second plurality of access ports, a fastened pocket, and a window;

wherein the face aperture, the first plurality of access ports, the second plurality of access ports, the fastened pocket, and the window attach to the block;

wherein the block is further defined with a first face, a second face, a third face, a fourth face, a fifth face, and a sixth face;

wherein the first face is the face of the block that is distal from the shoulder strap;

wherein the second face is the face of the block that is proximal to the tube;

wherein the third face is the face of the block that is distal from the first face of the block;

wherein the master pocket is a hollow rectangular block structure;

wherein the tube comprises a pipe;

wherein the pipe is a capped tube;

wherein the inner diameter of the pipe is greater than the outer diameter of the water bottle;

wherein the pipe is further defined with a first face, a first end, and a second end;

wherein the seventh face is the face of the cylinder that forms the pipe;

wherein the first end of the pipe is the open end;

wherein the second end of the pipe is the capped end.

2. The item of luggage according to claim 1 wherein the fourth face is the face of the block that is distal from the second face of the block;

wherein the fifth face is the face of the block that has the face aperture formed in it;

wherein the sixth face is the face of the block that is distal from the fifth face of the block.

3. The item of luggage according to claim 2 wherein the third face is hinged such that the third face can be rotated away from the interior space of the block.

4. The item of luggage according to claim 3 wherein wherein the face aperture is an aperture that is formed through the fifth face of the block;

wherein the face aperture is sized and positioned such that the display of the personal data device may be directly accessed without removing the personal data device from the master pocket.

5. The item of luggage according to claim 4 wherein the face aperture is a rectangular opening.

6. The item of luggage according to claim 5 wherein each of the first plurality of access ports is an aperture that is formed through the third face of the block;

wherein each of the first plurality of access ports is sized and positioned such that a switch mounted on the exterior surface of the personal data device may be directly accessed without removing the personal data device from the master pocket.

7. The item of luggage according to claim 6 wherein each of the second plurality of access ports is an aperture that is formed through the fourth face of the block;

wherein each of the second plurality of access ports is sized and positioned such that a switch mounted on the exterior surface of the personal data device may be directly accessed without removing the personal data device from the master pocket.

8. The item of luggage according to claim 7 wherein the fastened pocket comprises a fastener and a first sheeting;

wherein the fastener opens and closes the fastened pocket.

9. The item of luggage according to claim 8 wherein the first sheeting is a composite textile;

wherein the first sheeting comprises one or more layers of conductive material that form a Faraday cage around the fastened pocket.

10. The item of luggage according to claim 9 wherein the shoulder strap is a flexible strap structure that is connected to both the tube and the master pocket;

wherein the shoulder strap forms the loop;

wherein the loop forms an enclosed negative space through which an object can be inserted.

11. The item of luggage according to claim 10 wherein the shoulder strap comprises a first strap, a second strap, wherein the first strap is further defined with a third end and a fourth end;

wherein the second strap is further defined with a fifth end and a sixth end;

wherein the third end of the first strap attaches to the fourth face of the block;

wherein the fourth end of the first strap is a free end;

wherein the fifth end of the second strap attaches to the seventh face of the pipe;

wherein the sixth end of the second strap is a free end.

12. The item of luggage according to claim 11 wherein the shoulder strap further comprises a shoulder pad;

wherein the shoulder pad is a cushion that is formed in a loop such that the first strap can be inserted through the shoulder pad.

13. The item of luggage according to claim 12 wherein the shoulder strap further comprises a first ring and a second ring;

wherein the first ring is a first ring shaped linking structure;

wherein the fourth end of the first strap and the sixth end of the second strap are inserted through the first ring;

wherein the second ring is a second ring shaped linking structure;

wherein the fourth end of the first strap and the sixth end of the second strap are inserted through the second ring;

wherein the first strap and the second strap are simultaneously inserted through the first ring;

wherein the first strap and the second strap are simultaneously inserted through the second ring.

14. The item of luggage according to claim 13 wherein the shoulder strap further comprises a plurality of clip loops;

wherein each of the plurality of clip loops is a ring like structure;

wherein each of the plurality of clip loops attaches to the first strap.

15. The item of luggage according to claim 14 wherein the fastener is a zipper;

wherein the first strap is a first webbing;

wherein the second strap is a second webbing.

* * * * *